US008707982B2

(12) United States Patent
Wu

(10) Patent No.: US 8,707,982 B2
(45) Date of Patent: Apr. 29, 2014

(54) ANTI-FREEZE VACUUM BREAKING STRUCTURE FOR A FAUCET

(75) Inventor: Hung-Neng Wu, Lukang Township, Changhua County (TW)

(73) Assignee: Ning Woei Enterprise Co., Ltd., Changhua County (TW)

( * ) Notice: Subject to any disclaimer, the term of this patent is extended or adjusted under 35 U.S.C. 154(b) by 149 days.

(21) Appl. No.: 13/481,933

(22) Filed: May 28, 2012

(65) Prior Publication Data

US 2013/0312845 A1 Nov. 28, 2013

(51) Int. Cl.
*E03B 9/02* (2006.01)
*E03C 1/10* (2006.01)

(52) U.S. Cl.
USPC ..... 137/301; 137/218; 137/360

(58) Field of Classification Search
USPC ..... 137/301, 218, 360, 454.5, 454, 6, 272
See application file for complete search history.

(56) References Cited

U.S. PATENT DOCUMENTS 6,805,154 B1 * 10/2004 Dickey et al. ..... 137/360
7,828,005 B2 * 11/2010 Lawson ..... 137/218
8,402,991 B2 * 3/2013 Wu ..... 137/301

* cited by examiner

*Primary Examiner* — Kevin Lee
(74) *Attorney, Agent, or Firm* — Alan Kamrath; Kamrath IP Lawfirm, P.A.

(57) ABSTRACT

An anti-freeze vacuum breaking structure for the faucet contains a tube body including a chamber, an inlet, an outlet, a connecting hole, and an intake valve; a control valve including a housing, a shaft bolt, a rod, a stopping sleeve, an upper ceramic piece, a lower ceramic piece, and a seat, the shaft bolt having a connecting segment and an actuating segment, a watering room, a through hole, the shaft bolt including an outflow orifice, the rod including an increased shoulder, the shoulder including a first stopping ring, the rod also including a decreased fitting section, the decreased filling section having a resilient element, an air channel, and an air bore, the rod including a second stopping ring; a handle including a rotating member coupling with a driving stem, the driving stem including one end with an aperture and another end fitted with the connecting segment.

6 Claims, 11 Drawing Sheets

ANTI-FREEZE VACUUM BREAKING STRUCTURE FOR A FAUCET

BACKGROUND OF THE INVENTION

1. Field of the Invention

The present invention relates to an anti-freeze vacuum breaking structure, and more particularly to an anti-freeze vacuum breaking structure for a faucet that can prevent water being frozen in the faucet in a frigid weather.

2. Description of the Prior Art

With reference to FIGS. 10 and 11, a conventional anti-freeze faucet comprises a tube body 40, a control valve 50, and a handle 60, wherein the tube body 40 includes a chamber 41 defined therein, an inlet 42 formed on one end thereof, an outlet 43 formed on another end thereof, a connecting hole 44, and an intake valve 45, wherein the inlet 42, the outlet 43, the connecting hole 44, and the intake valve 45 communicate with the chamber 41. The control valve 50 includes a shaft bolt 51 inserted in a housing 52, the shaft bolt 51 has a watering room 511 and a groove 512, the housing 52 includes an aperture 521 defined on a middle section of a peripheral wall thereof and a one-way stop loop 522 fitted on the peripheral wall thereof above the aperture 521. The shaft bolt 51 includes an upper ceramic piece 53 and a lower ceramic piece 54 fixed on a lower side thereof, the groove 512 includes a spring 513 secured therein, and the watering room 511 includes a check member 514 and a stop pad 515, the check member 514 includes a cover 5141 disposed on a bottom end thereof, and the cover 5141 includes a peg 5142 extending upward from a central position of a top surface thereof and inserted in the groove 512 of the shaft bole 51 to abut against the spring 513. The handle 60 is connected with the connecting hole 44 of the tube body 40 and includes a rod 61 inserted in the chamber 41 of the tube body 40. The rod 61 includes a connector 62 mounted on a distal end thereof, and the connector 62 couples with an upper end of the shaft bolt 51 of the control valve 50 such that the control valve 50 is turned on or off by rotating the handle 60.

However, such a conventional anti-freeze faucet can not achieve a vacuum breaking effect due to the intake valve 45 is limited and has an air opening, a diameter of which is limited as well. Accordingly, when stopping a water supply, some waters accumulate and freeze in the chamber 41 of the tube body 40, thus plunging the faucet in a frigid weather.

The present invention has arisen to mitigate and/or obviate the afore-described disadvantages.

SUMMARY OF THE INVENTION

The primary object of the present invention is to provide an anti-freeze vacuum breaking structure for a faucet that as stopping a water supply, an aperture of a rod of a handle communicates with an outflow orifice of a shaft bolt of a control valve, and an air feeding effect results from an intake valve of a tube body, thereby obtaining a vacuum breaking effect to prevent water from being accumulated and frozen in a chamber of a tube body.

An anti-freeze vacuum breaking structure for a faucet in accordance with a preferred embodiment of the present invention contains:

a tube body including a chamber defined therein, an inlet formed on one end thereof, an outlet formed on another end thereof, a connecting hole, and an intake valve, the inlet, the outlet, the connecting hole, and the intake valve communicating with the chamber;

a control valve fixed in the chamber of the tube body and including a housing, a shaft bolt, a rod, a stopping sleeve, an upper ceramic piece, a lower ceramic piece, and a seat, the shaft bolt being inserted into the housing and having a connecting segment and an actuating segment relative to the connecting segment, a watering room extending from the actuating segment of the shaft bolt, a through hole extending from the connecting segment to communicate with the watering room, the shaft bolt including an outflow orifice defined on an outer side thereof to communicate with the watering room, the connecting segment and the outflow orifice extending out of the housing, the rod being inserted into the shaft bolt and including an increased shoulder arranged on one end thereof, the shoulder including a first stopping ring fitted thereon, the rod also including a decreased fitting section defined on another end thereof relative to the increased shoulder, the decreased fitting section having a resilient element fitted thereon, an air channel, and an air bore to communicate with the air channel, the rod including a second stopping ring fitted on an outer peripheral wall thereof adjacent to the fitting section, the upper ceramic piece being fitted in the housing to engage and drive the actuating segment of the shaft bolt, the lower ceramic piece being fitted in the housing and contacting with the upper ceramic piece, the seat screwing with the housing and including an intake passed therein;

a handle connected with the connecting hole of the tube body and including a rotating member coupling with a driving stem and inserted in the chamber of the tube body, the driving stem being hollow and including one end with an aperture to connect with the rotating member and including another end fitted with the connecting segment of the shaft bolt of the control valve.

DETAILED DESCRIPTION OF THE PREFERRED EMBODIMENTS

Figure 1:
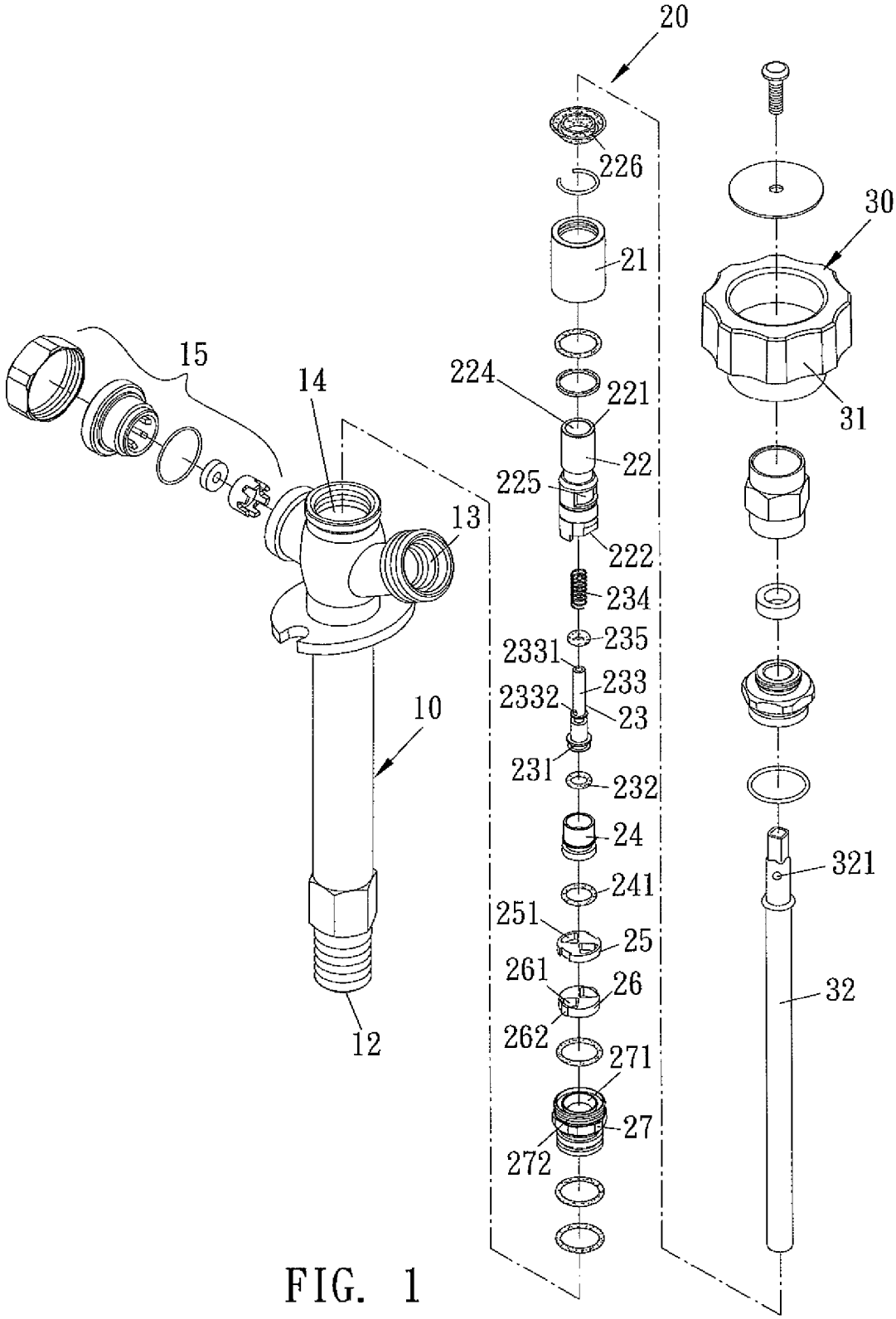
FIG. 1 is a perspective view showing the exploded components of an anti-freeze vacuum breaking structure for a faucet in accordance with a preferred embodiment of the present invention.
Figure 2:
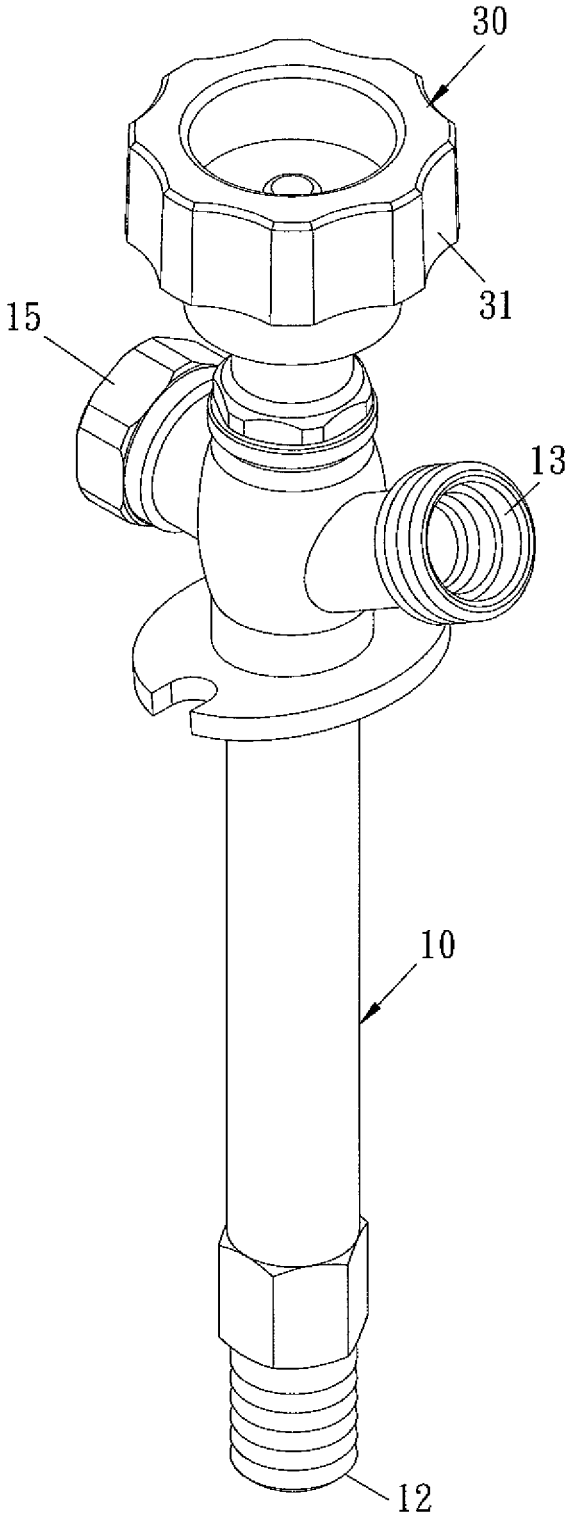
FIG. 2 is a perspective view showing the assembly of the anti-freeze vacuum breaking structure for the faucet in accordance with the preferred embodiment of the present invention.
Figure 3:
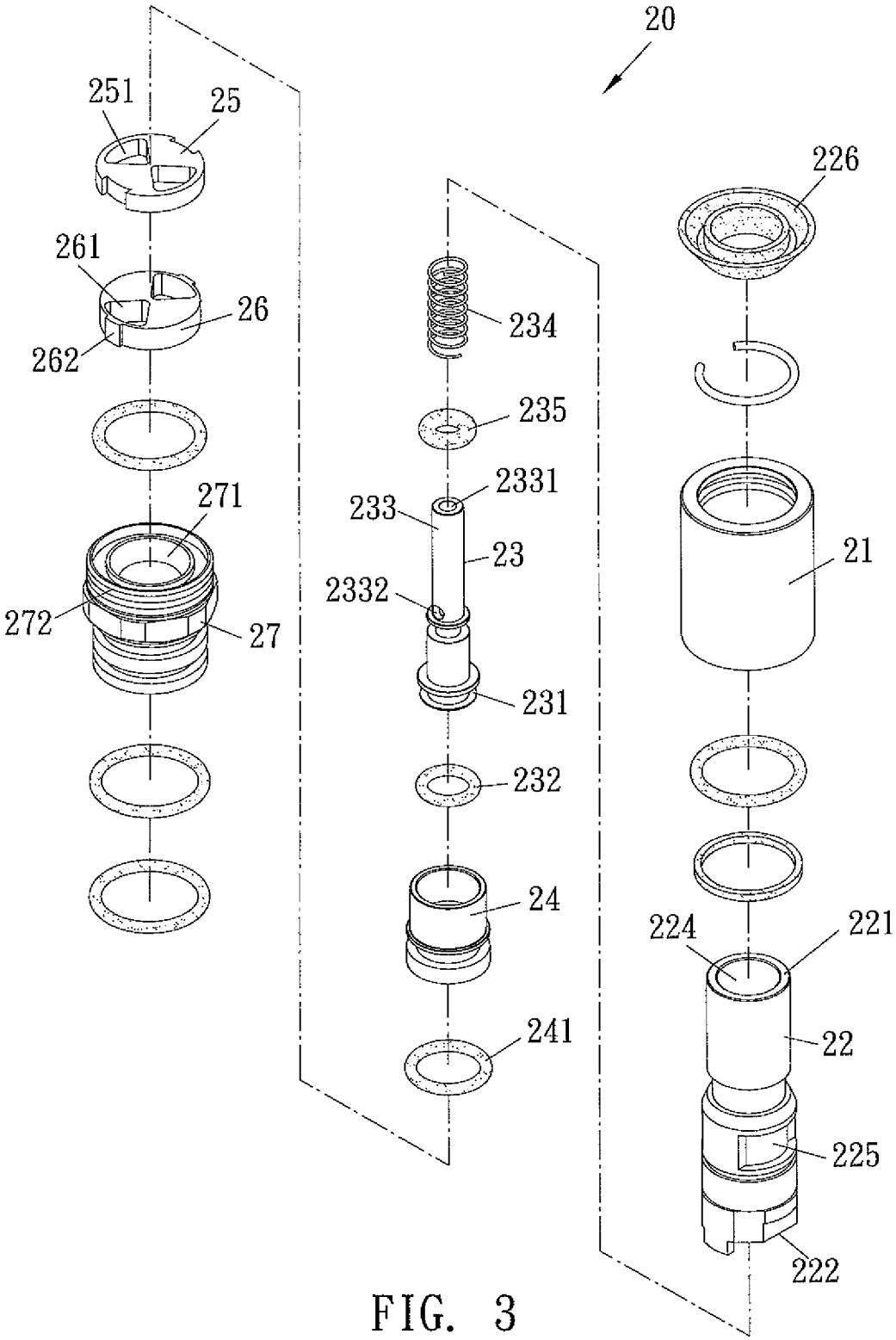
FIG. 3 is a perspective view showing the exploded components of a control valve of the anti-freeze vacuum breaking structure for the faucet in accordance with the preferred embodiment of the present invention.
Figure 4:
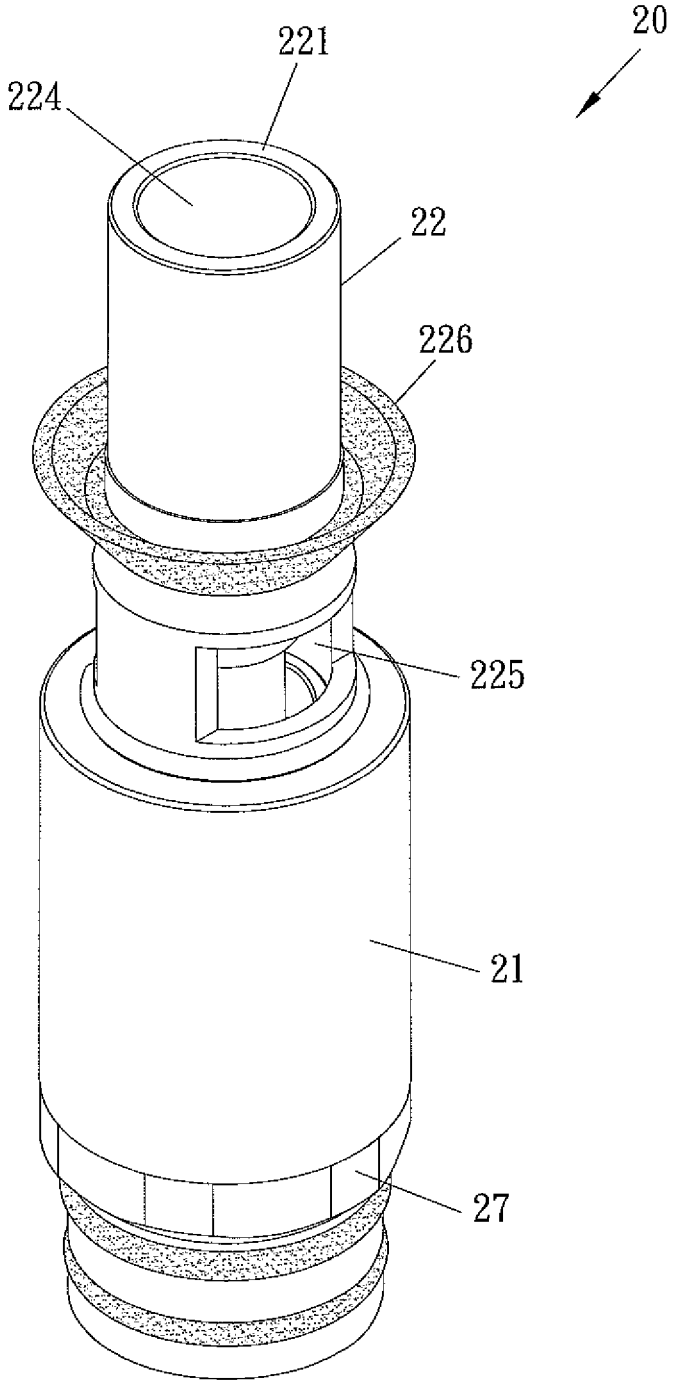
FIG. 4 is a perspective view showing the assembly of a control valve of the anti-freeze vacuum breaking structure for the faucet in accordance with a preferred embodiment of the present invention.
Figure 5:
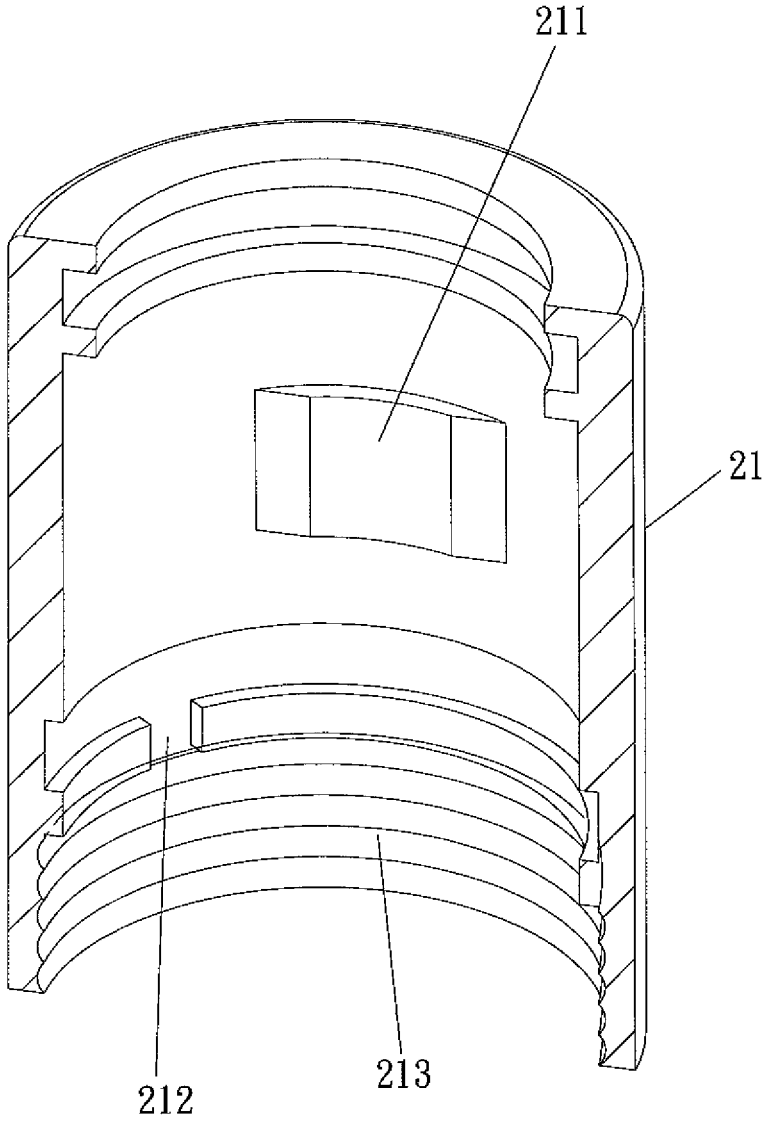
FIG. 5 is a cross-sectional perspective view of a housing of the control valve of the anti-freeze vacuum breaking structure for the faucet in accordance with a preferred embodiment of the present invention.
Figure 6:
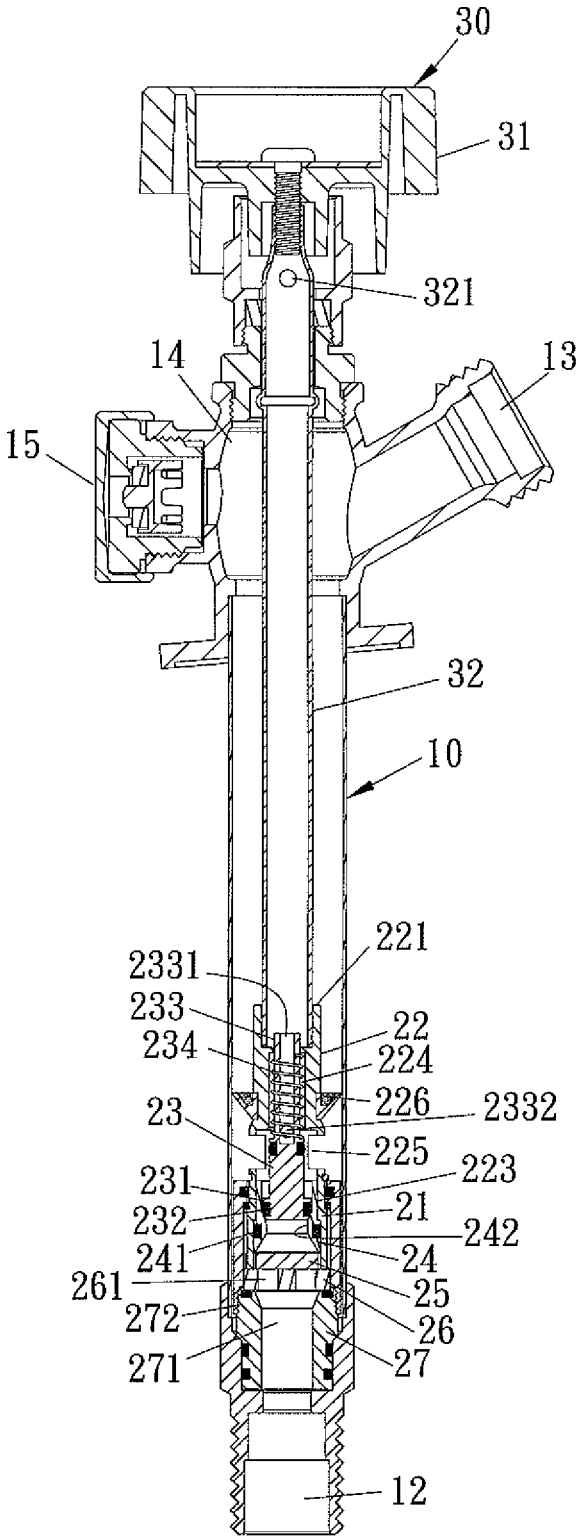
FIG. 6 is a cross-sectional view showing the assembly of the anti-freeze vacuum breaking structure for the faucet in accordance with the preferred embodiment of the present invention.
Figure 7:
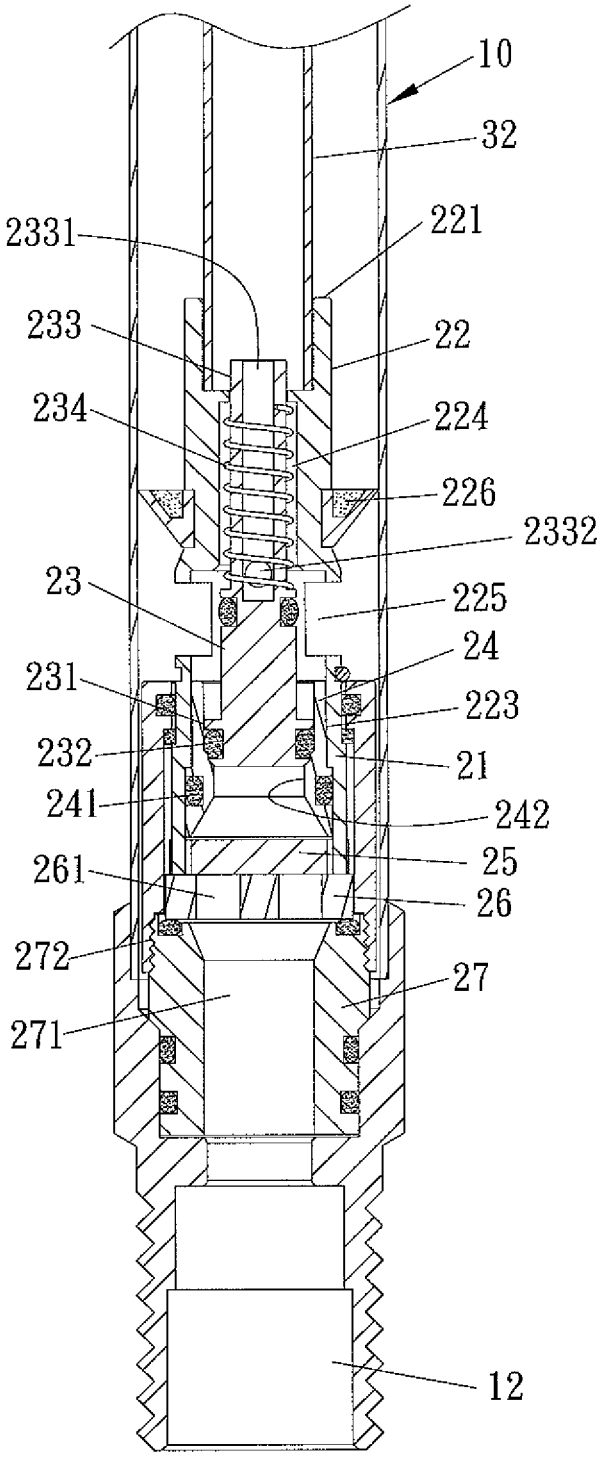
FIG. 7 is a cross-sectional view showing the assembly of a part of the anti-freeze vacuum breaking structure for the faucet in accordance with the preferred embodiment of the present invention.

The present invention will be clearer from the following description when viewed together with the accompanying drawings, which show, for purpose of illustrations only, the preferred embodiment in accordance with the present invention.

Referring to FIGS. 1-7, an anti-freeze vacuum breaking structure for a faucet comprises a tube body 10, a control valve 20, and a handle 30.

The tube body 10 includes a chamber 11 defined therein, an inlet 12 formed on one end thereof to connect with an inlet tube, an outlet 13 formed on another end thereof, a connecting hole 14, and an intake valve 15, wherein the inlet 12, the outlet 13, the connecting hole 14, and the intake valve 15 communicate with the chamber 11.

The control valve 20 is fixed in the chamber 11 of the tube body 10 and includes a housing 21, a shaft bolt 22, a rod 23, a stopping sleeve 24, an upper ceramic piece 25, a lower ceramic piece 26, and a seat 27. The housing 21 includes two limiting ribs 211 arranged on an inner wall thereof, two positioning recesses 212 below the two limiting ribs 211, and a screwing section 213 formed on a bottom end of the inner wall thereof. The shaft bolt 22 has a connecting segment 221 and an actuating segment 222 relative to the connecting segment 221, a watering room 223 defined on the actuating segment 222 of the shaft bolt 22, a through hole 224 formed on the connecting segment 221 to communicate with the watering room 223, between the connecting segment 221 and the actuating segment 222 of the shaft bolt 22 are defined an outflow orifice 225 communicating with the watering room 223 and a one-way stop loop 226, and the shaft bolt 22 is inserted into the housing 21 to be limited by the two limiting ribs 211 such that the shaft bolt 22 rotates at a certain angle. The connecting segment 221 and the outflow orifice 225 of the shaft bolt 22 extend out of the housing 21. The rod 23 is inserted into the shaft bolt 22 and includes an increased shoulder 231 arranged on one end thereof, wherein the shoulder 231 includes a first stopping ring 232 fitted thereon, the rod 23 also includes a decreased fitting section 233 defined on another end thereof relative to the increased shoulder 231. The decreased fitting section 223 has a resilient element 234 fitted thereon, an air channel 2331, and an air bore 2332 to communicate with the air channel 2331. The rod 23 includes a second stopping ring 235 fitted on an outer peripheral wall thereof adjacent to the fitting section 233. The stopping sleeve 24 is hollow and is fixed in the watering room 223 of the shaft bolt 22 and includes a stepped outer wall on which a third stopping ring 241 is fitted and an inner wall on which a neck 242 is defined to retain with the increased shoulder 231 and the first stopping ring 232 of the shoulder 231 to generate a close state. The upper ceramic piece 25 is fitted in the housing 21 to engage and drive the actuating segment 222 of the shaft bolt 22 and includes two symmetrical first openings 251. The lower ceramic piece 26 is fitted in the housing 21 and contacts with the upper ceramic piece 25 and includes two symmetrical second openings 261 and two opposite projections 262 mounted on an outer rim thereof to retain with the two positioning recesses 212. The seat 27 includes an intake 271 passed therein and a coupling section 272 with threads formed on an outer wall of an upper end thereof to screw with the screwing section 213 of the housing 21.

The handle 30 is connected with the connecting hole 14 of the tube body 10 and includes a rotating member 31 coupling with a driving stem 32 and inserted in the chamber 11 of the tube body 10. The driving stem 32 is hollow and includes one end with an aperture 321 to connect with the rotating member 31 and another end fitted with the connecting segment 221 of the shaft bolt 22 of the control valve 20.

Figure 8:
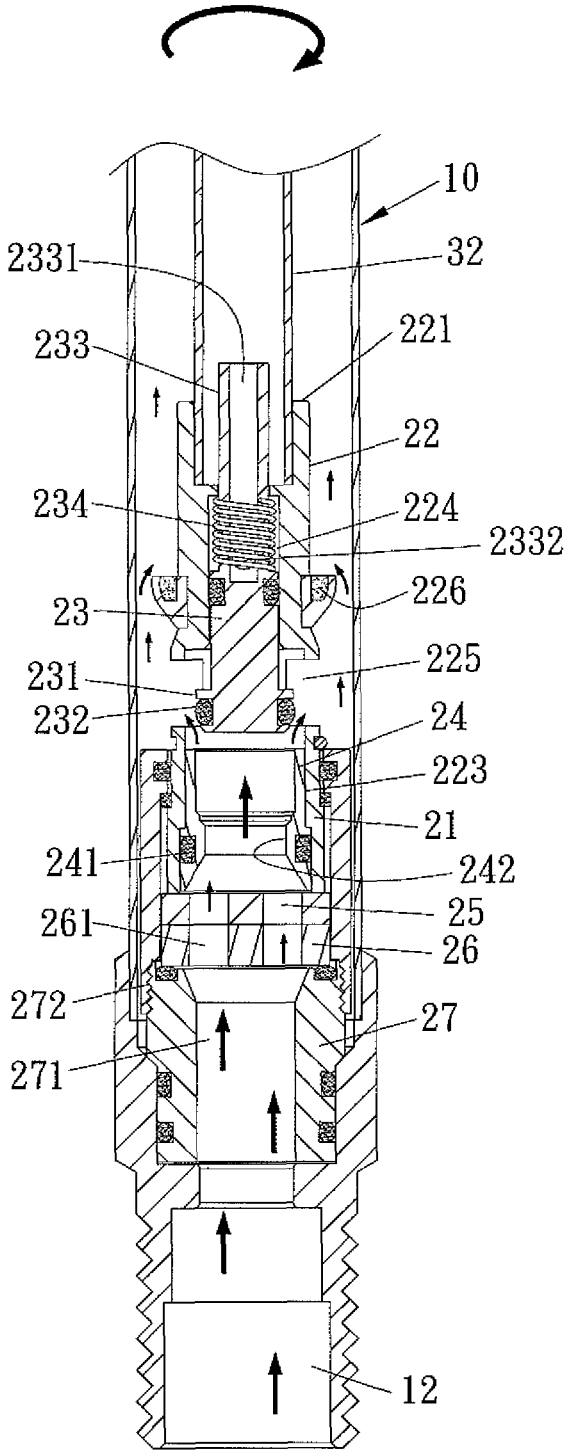
FIG. 8 is a cross-sectional view showing the operation of the anti-freeze vacuum breaking structure for the faucet in accordance with the preferred embodiment of the present invention.

When turning on the faucet as shown in FIG. 8, the rotating member 31 of the handle 30 is rotated so that the driving stem 32 drives the shaft bolt 22 of the control valve 20 to rotate an angle, and the actuating segment 222 of the shaft bolt 22 drives the upper ceramic piece 25 to rotate simultaneously so that the two symmetrical first openings 251 of the upper ceramic piece 25 align and communicate with the two symmetrical second openings 261 of the lower ceramic piece 26 such that water flows into the inlet 12 of the tube body 10 via the intake 271 of the seat 27 of the control valve 20, the two symmetrical second openings 261 of the lower ceramic piece 26, and the two symmetrical first openings 251 of the upper ceramic piece 25 to push the rod 23 so that the resilient element 234 of the fitting section 233 of the rod 23 is pressed, the air bore 2332 of the fitting section 233 of the rod 23 is closed by the second stopping ring 235, the increased shoulder 231 of the rod 23 and the first stopping ring 232 of the increased shoulder 231 disengage from the stepped outer wall of the stopping sleeve 24 so that the water flows into the chamber 11 of the tube body 10 from the outflow orifice 225 of the shaft bolt 22 and then further flows out of the outlet 13 of the tube body 10 via the one-way stop loop 226, thus supplying water.

Figure 9:
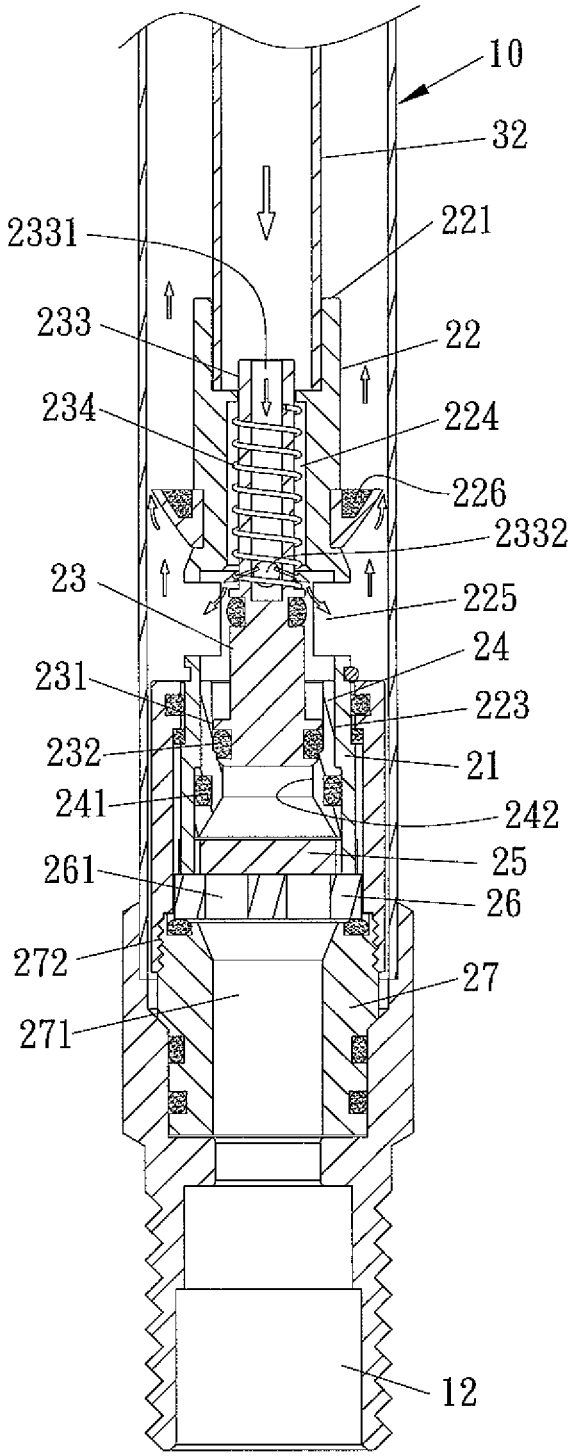
FIG. 9 is another cross-sectional view showing the operation of the anti-freeze vacuum breaking structure for the faucet in accordance with the preferred embodiment of the present invention.
Figure 10:
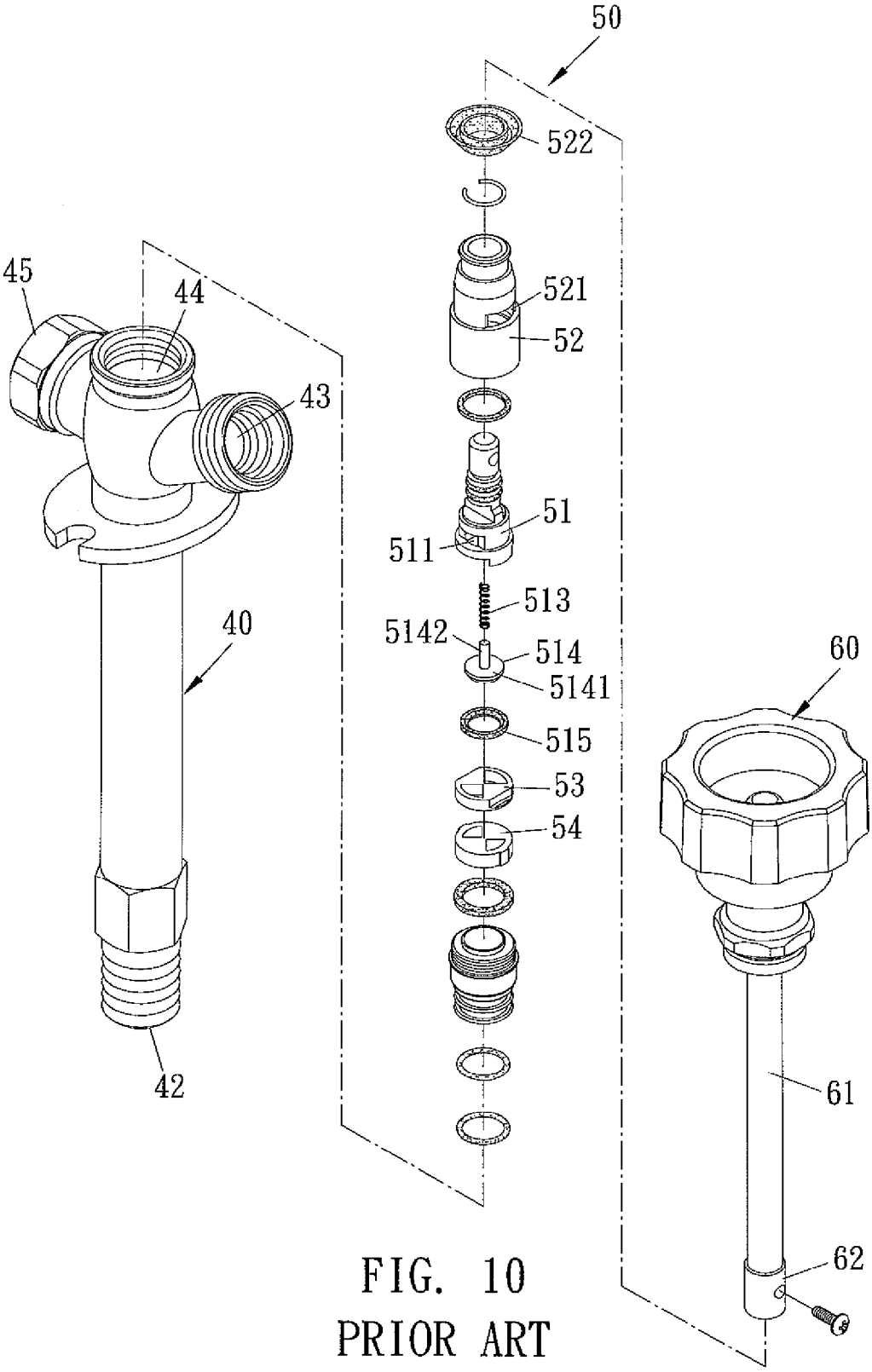
FIG. 10 PRIOR ART
FIG. 10 is a perspective view showing the exploded components of a conventional anti-freeze vacuum breaking structure for a faucet.
Figure 11:
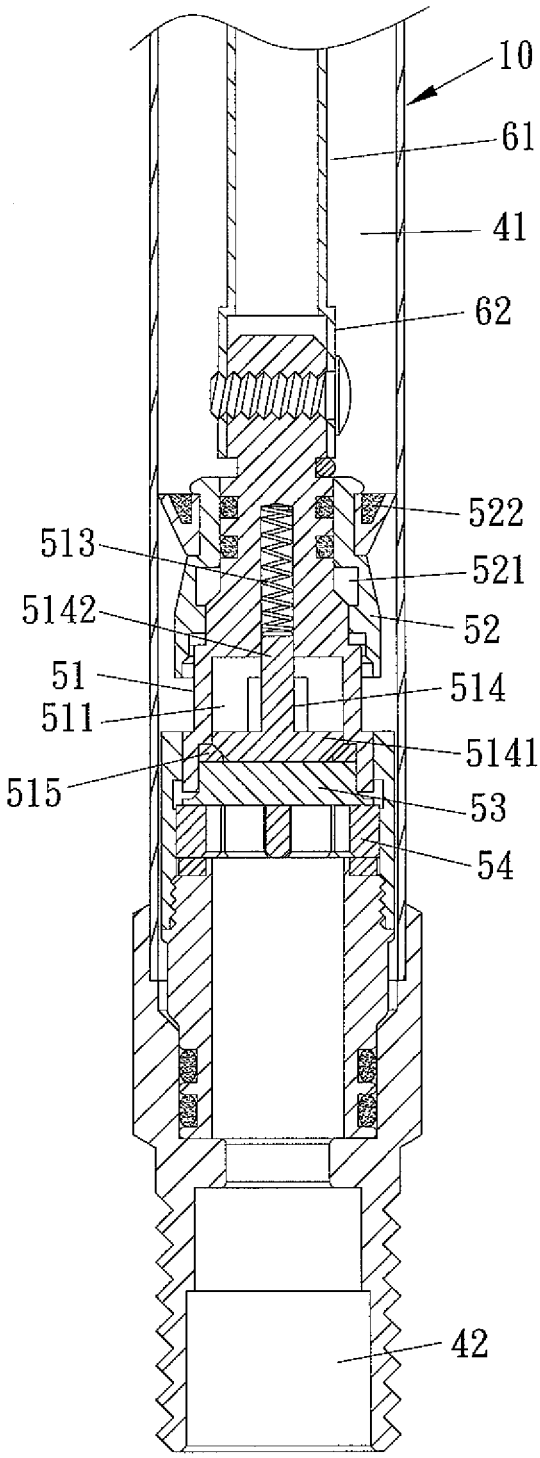
FIG. 11 PRIOR ART
FIG. 11 is a cross-sectional view showing the assembly of a part of the anti-freeze vacuum breaking structure for the faucet in accordance with the conventional anti-freeze vacuum breaking structure for the faucet.

When turning off the faucet as illustrated in FIG. 9, the rotating member 31 of the handle 30 is rotated reversely so that the driving stem 32 drives the shaft bolt 22 of the control valve 20 to rotate back to an original position, and the actuating segment 222 of the shaft bolt 22 drives the upper ceramic piece 25 to rotate simultaneously so that the two symmetrical first openings 251 of the upper ceramic piece 25 do not align and communicate with the two symmetrical second openings 261 of the lower ceramic piece 26, and the rod 23 moves backward by using the resilient element 234 so that the increased shoulder 231 and the first stopping ring 232 of the increased shoulder 231 retains with the neck 242 of the inner wall of the stopping sleeve 24 to generate the close state, in the meantime, the air bore 2332 of the fitting section 233 of the rod 23 communicates with the outflow orifice 225 of the shaft bolt 22 so that the chamber 11 of the tube body 10 communicates with an external environment through the air bore 2332 of the fitting section 233 of the rod 23, the air channel 2331, the driving stem 32, and the aperture 321 of the driving stem 32, and an air feeding effect results from the intake valve 15 of the tube body 10, thereby obtaining a vacuum breaking effect to flow the water out of the chamber 11 of the tube body 10.

While we have shown and described various embodiments in accordance with the present invention, it is clear to those skilled in the art that further embodiments may be made without departing from the scope of the present invention.

What is claimed is:

1. An anti-freeze vacuum breaking structure for a faucet comprises:

a tube body including a chamber defined therein, an inlet formed on one end thereof, an outlet formed on another end thereof, a connecting hole, and an intake valve, the inlet, the outlet, the connecting hole, and the intake valve communicating with the chamber;

a control valve fixed in the chamber of the tube body and including a housing, a shaft bolt, a rod, a stopping sleeve, an upper ceramic piece, a lower ceramic piece, and a seat, the shaft bolt being inserted into the housing and having a connecting segment and an actuating segment relative to the connecting segment, a watering room extending from the actuating segment of the shaft bolt, a through hole extending from the connecting segment to communicate with the watering room, the shaft bolt including an outflow orifice defined on an outer side thereof to communicate with the watering room, the connecting segment and the outflow orifice extending out of the housing, the rod being inserted into the shaft bolt and including an increased shoulder arranged on one end thereof, the shoulder including a first stopping ring fitted thereon, the rod also including a decreased fitting section defined on another end thereof relative to the increased shoulder, the decreased fitting section having a resilient element fitted thereon, an air channel, and an air bore to communicate with the air channel, the rod including a second stopping ring fitted on an outer peripheral wall thereof adjacent to the fitting section, the upper ceramic piece being fitted in the housing to engage and drive the actuating segment of the shaft bolt, the lower ceramic piece being fitted in the housing and contacting with the upper ceramic piece, the seat screwing with the housing and including an intake passed therein;

a handle connected with the connecting hole of the tube body and including a rotating member coupling with a driving stem and inserted in the chamber of the tube body, the driving stem being hollow and including one end with an aperture to connect with the rotating member and including another end fitted with the connecting segment of the shaft bolt of the control valve.

2. The anti-freeze vacuum breaking structure for the faucet as claimed in claim 1, wherein the housing of the control valve includes two limiting ribs arranged on an inner wall thereof and two positioning recesses below the two limiting ribs.

3. The anti-freeze vacuum breaking structure for the faucet as claimed in claim 1, wherein the housing of the control valve includes a screwing section formed on a bottom end of the inner wall thereof, the seat of the control valve includes a coupling section with threads formed on an outer wall thereof.

4. The anti-freeze vacuum breaking structure for the faucet as claimed in claim 1, wherein between the connecting segment and the actuating segment of the shaft bolt is defined a one-way stop loop.

5. The anti-freeze vacuum breaking structure for the faucet as claimed in claim 1, wherein the stopping sleeve is fixed in the watering room of the shaft bolt of the control valve and is hollow and includes a stepped outer wall on which a third stopping ring is fitted and an inner wall on which a neck is defined.

6. The anti-freeze vacuum breaking structure for the faucet as claimed in claim 1, wherein the upper ceramic piece of the control valve is fitted in the housing to engage and drive the actuating segment of the shaft bolt and includes two symmetrical first openings, the lower ceramic piece is fitted in the housing and contacts with the upper ceramic piece and includes two symmetrical second openings and two opposite projections mounted on an outer rim thereof to retain with the two positioning recesses.

* * * * *